US005284268A

United States Patent [19]

Marsan et al.

[11] Patent Number: 5,284,268

[45] Date of Patent: Feb. 8, 1994

[54] COMBINATION PAPER AND TRASH RECEPTACLE

[76] Inventors: Normand Marsan, 10791, St-Laurent, Montreal, Quebec, Canada, H3L 2P8; Robert Cossette, 4418, Christophe Colomb, Montreal, Quebec, Canada, H3C 2M7

[21] Appl. No.: 956,996

[22] Filed: Oct. 6, 1992

[30] Foreign Application Priority Data

Nov. 15, 1991 [GB] United Kingdom ..... 9121819

[51] Int. Cl.[5] ..... B65D 21/02

[52] U.S. Cl. ..... 220/23.83; 220/909; 220/404; 220/523; 220/505

[58] Field of Search ..... 220/484, 524, 338, 337, 220/335, 908, 909, 410, 408, 404, 403, 521, 505, 523, 527, 529, 500, 212.5, 23.83, 23.86, 23.8, 23.6

[56] References Cited

U.S. PATENT DOCUMENTS

| | | | |
|---|---|---|---|
| 1,606,291 | 11/1926 | Burrows | 220/527 |
| 2,747,388 | 5/1956 | Dolar | 220/23.83 |
| 3,442,435 | 5/1969 | Ludder et al. | 220/410 |
| 3,446,386 | 5/1969 | Wellington | 220/521 |
| 3,675,813 | 7/1972 | Morgan | 220/212.5 |
| 3,893,615 | 7/1975 | Johnson | 220/909 |
| 4,893,722 | 1/1990 | Jones | 220/23.83 |
| 4,948,004 | 8/1990 | Chich | 220/909 |
| 5,076,458 | 12/1991 | Weiner et al. | 220/908 |
| 5,111,958 | 5/1992 | Witthoeft | 220/23.83 |
| 5,169,012 | 12/1992 | Labrie | 220/404 |

FOREIGN PATENT DOCUMENTS

| | | | |
|---|---|---|---|
| 383166 | 2/1922 | Fed. Rep. of Germany | 220/523 |

*Primary Examiner*—Allan N. Shoap
*Assistant Examiner*—S. Castellano

[57] ABSTRACT

A compartmented waste receptacle for segregating unrecyclable trash and recyclable paper. The receptacle has a main body and a secondary body releasably fixed to the main body. A spacing between the bottom walls of the secondary body and the main body defines a volume in which the recyclable paper is stored. A spacing between the secondary body and main body front walls define a chute leading to the recyclable paper storage volume. The main body and secondary body are adapted to be emptied independently.

7 Claims, 5 Drawing Sheets

COMBINATION PAPER AND TRASH RECEPTACLE

FIELD OF THE INVENTION

The present invention relates to the field of waste receptacles and more particularly to a compartmented office type of waste receptacle adapted to contain both recyclable paper and conventional trash and to facilitate ergonomical handling thereof.

BACKGROUND OF THE INVENTION

Public awareness towards major issues such as pollution, waste disposal, and undue squandering of trees has increased drastically over the last few years. As a result, measures such as recycling have become increasingly popular and are now even institutionalized in some areas.

Many offices now ask their employees to segregate their waste and to dispose of used paper in recycling bins. Typically some offices have a central recycling bin ofter furnished by the paper recycling companies in which employees are encouraged to dump their recyclable paper. However, this type of practice requires that the employee leave his desk and transport the recyclable paper to the appropriate bin.

To circumvent this problem, the present invention proposes an individual compartmented waste basket which allows the user to segregate recyclable paper from other type of trash at his desk. Since the waste basket is particularly adapted to be used underneath office desks, the compartments are located one on top of the other in order to save on limited horizontal space. The waste basket comprises a lower compartment specifically adapted to receive recyclable paper and a top compartment adapted to receive conventional trash.

A search amongst previous patents has revealed a number of compartmented refuse containers having superposed compartments with the lower compartment specifically adapted to receive paper.

U.S. Pat. No. 4,941,653 discloses a combination trash receptacle for storing newspapers and other trash separately which includes a lower newspaper receptacle formed of a receptacle base having a floor and upwardly extending walls for receipt of the newspaper and positioned thereupon an upper trash receptacle having a floor therein and upwardly extending walls dimensioned so as to nest upon the lower newspaper receptacle. A newspaper slot is positioned within one of the walls of the upper trash receptacle to permit passage of newspapers into the lower newspaper receptacle.

U.S. Pat. No. 4,944,419 discloses another type of trash receptacle particularly adapted to receive paper in its lower compartment and having a top opening. The container has at least one pair of apertures in a side wall thereof, through one of which a divider panel is removably inserted to form a false bottom for the relatively top portion of the container. The other aperture serves as an entry port for loading one type of refuse in the relatively bottom portion of the container. The top portion is loaded with a second type, meanwhile, through the top opening; and when the container is to be emptied, the integrity of each type is preserved by unloading the top portion first and then removing the panel to expose the bottom portion of the container to the top opening.

However, both structures described in the above mentioned patents present the same major drawbacks.

The first of these drawbacks is that the top receptacle must be removed or emptied prior to emptying the lowermost receptacle. This limitation is clearly indicated at line 32 of the second column of the disclosure of U.S. Pat. No. 4,941,653 and at line 63 of the first column of U.S. Pat. No. 4,944,419.

The second major drawback inherent to the structures described in these patents is that they do not provide a stacking chute adapted to direct the paper being dropped to the lower compartment in an appropriate stacking position. U.S. Pat. No. 4,941,653 provides a slot 24 and U.S. Pat. No. 4,944,419 an aperture 14 which leads directly to the lower receptacle. With the present invention, a chute is provided in order to guide the paper during its fall to a proper stacking relationship thus minimizing the risk of the paper folding during its fall.

SUMMARY OF THE INVENTION

According to the present invention there is provided a compartmented waste receptacle for segregating different types of waste. A main container body includes a main body front wall, a main body back wall, a set of main body side walls and a main body bottom wall. A secondary container body positioned inside the main container body includes a secondary body front wall, a secondary body back wall and a set of secondary body side walls and bottom wall. The secondary container body is fixed to the main container body with the secondary bottom wall positioned above the main body bottom wall. The secondary body and main body bottom walls, a portion of the main body side wall and a portion of the main body back wall defines a lower compartment into which the recyclable paper will be dropped. The secondary body front wall is spaced from the main body front wall such that the secondary and main body front walls define a chute leading to the lower compartment into which the recyclable paper will be dropped. The secondary body is adapted to receive the unrecyclable trash.

The secondary container body is removably fixed to the main container body by releasable fastening means. The secondary container body is adapted to be emptied independently from the main container body.

The secondary container body has a rim extending integrally from the secondary body front, back and side walls. The main body front, back and side wall have an upper edge. The rim of the secondary body back and side wall is adapted to correspondingly rest on the rim of the main body back and side walls.

In the preferred embodiment, the releasable fastening means comprises a protuberant locking bar which extends from the main body back wall and a corresponding locking lip which extends integrally from the rim of the secondary body back wall. The rim is adapted to snappingly engage below the lip for releasably locking the secondary body to the main container body.

The waste receptacle further comprises an hinged cover adapted to pivot between an opened and a closed position. The cover is adapted to partially cover an opened top portion of the chute when the cover is positioned in its closed position.

The cover comprises a pair of integrally and downwardly extending side flanges and a pair of inwardly projecting pins extending integrally from the side flanges. The pins are adapted to be inserted into a pair of corresponding pivot apertures provided in the main container body side walls.

The hinged cover comprises an upwardly slanted front portion and a spacing between the main container body front wall and the upwardly slanted front portion. The spacing defines an inlet port adapted to allow a user to insert a piece of recyclable paper in the chute when a cover is in its closed position.

The upper edge of the side walls is provided with a substantially V-shaped notch. A rearward edge of the cover is adapted to engage the V-shaped notch when the cover is in its opened position.

The waste receptacle is ideally provided with a prehension aperture which extends through both the main container and secondary body back walls.

DETAILED DESCRIPTION OF THE INVENTION

Figure 1:
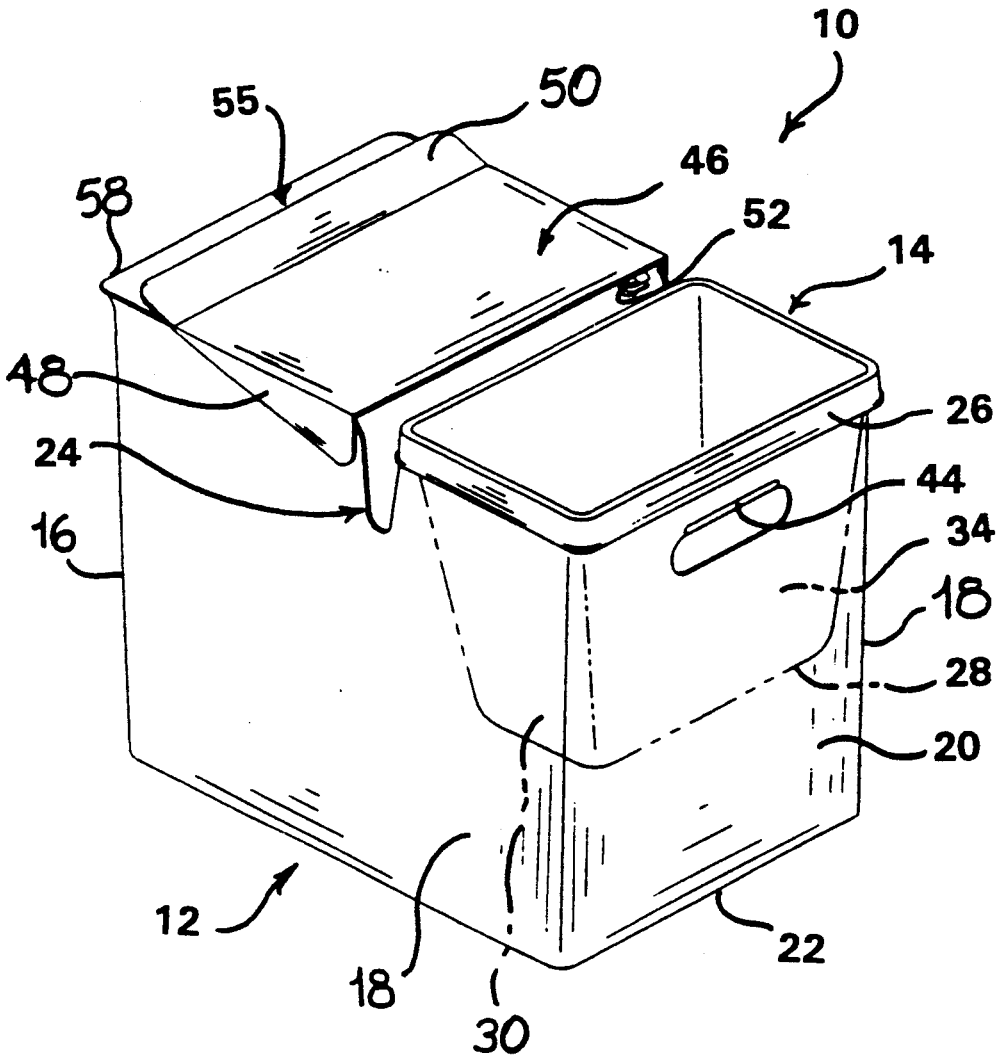
FIG. 1 is a perspective view of the compartmented waste receptacle embodying the invention.
Figure 2:
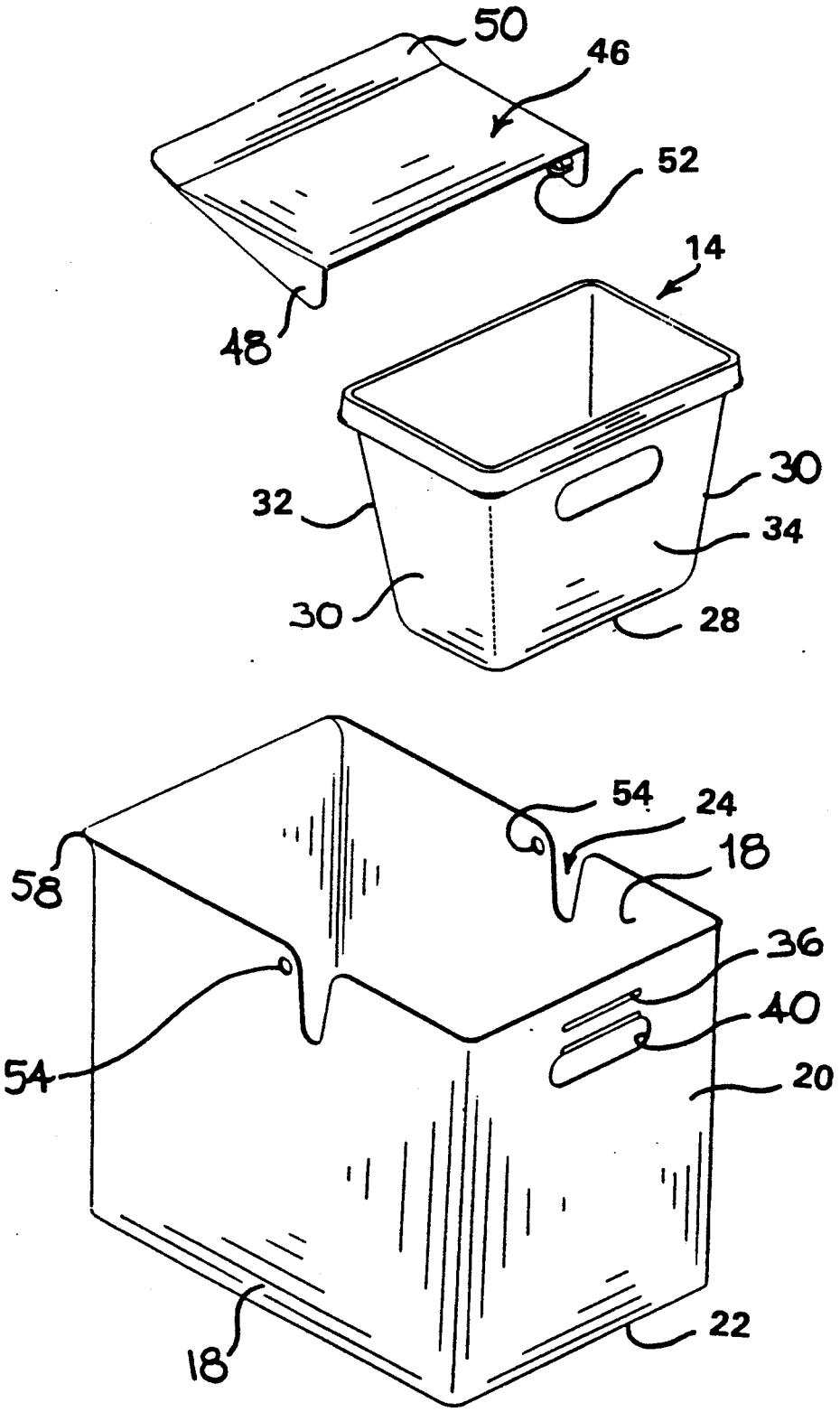
FIG. 2 is a perspective view of the invention with its upper basket in a removed position and with the cover removed.

Referring to FIG. 1, there is shown a compartmented waste receptacle 10 having a main container box-like body 12 and a secondary removable basket 14. The main body 12 has a front wall 16, a pair of sidewalls 18 and a back wall 20 all extending integrally from a base wall 22. The upper edge of both sidewalls 18 is provided with a substantially V-shaped notch 24.

The removable basket 14 is provided with an inverted substantially V-shaped rim 26 adapted to rest on the upper edge of the back wall 20 and the portion of the sidewalls 18 between the notch 24 and the back wall 20. The basket 14 is an open top container body having a base wall 28. A pair of sidewalls 30, a front wall 32 and a back wall 34 all extend integrally from the base wall 28 at their bottom end and extend integrally into the rim 26 at their upper end.

Figure 3:
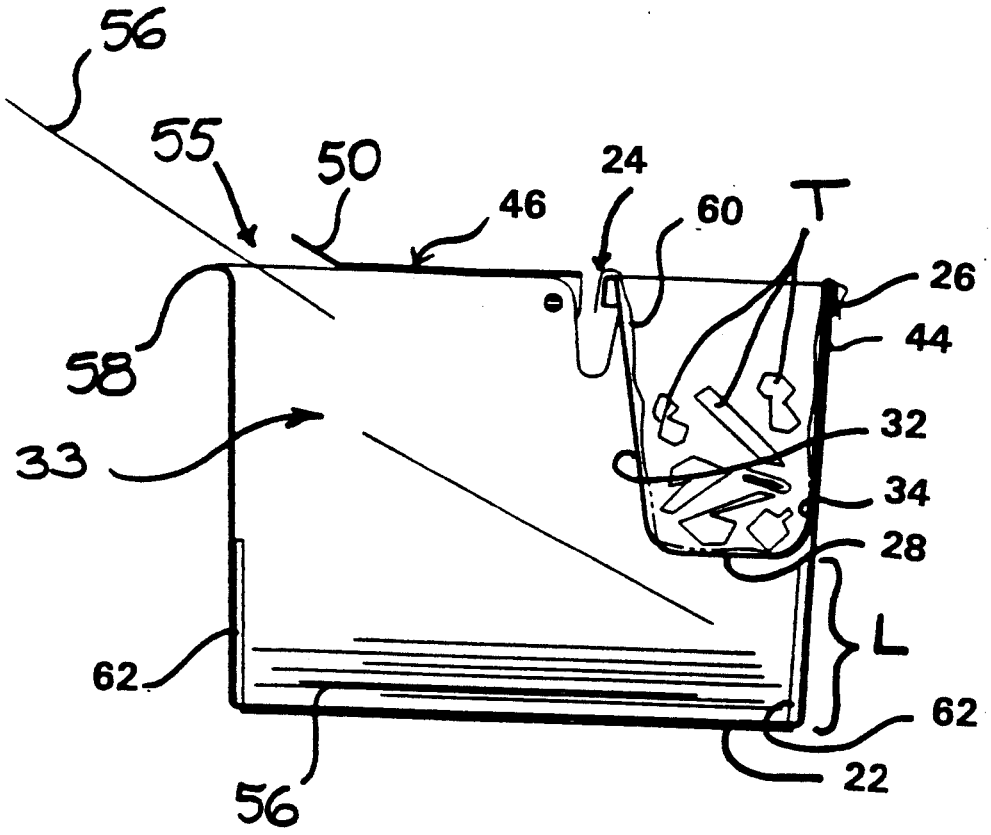
FIG. 3 is a longitudinal cross-sectional view taken along line 3—3 of FIG. 1 and illustrating paper being dropped into the lower compartment.
Figure 3A:
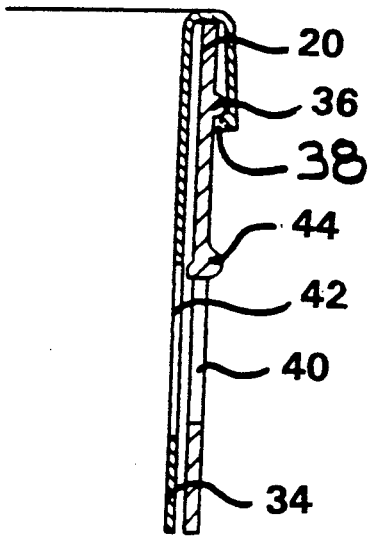
FIG. 3*a* is a detailed close-up view of the connection between the main body and the basket.

As illustrated in FIG. 3, the base wall 28 of the basket 14 is positioned above the base wall 22 of the main body 12. The spacing, between the base walls 22 and 28, defines a lower compartment, indicated by the reference letter L, into which the recyclable paper, indicated by the reference numeral 56, is adapted to be piled in a stacked relationship.

As illustrated in FIGS. 1 and 3, the front wall 32 and the sidewalls 30 taper downwardly while the back wall 34 is adapted to lie in the planes substantially parallel to the back wall 20 of the main body 12.

The back wall 20 is provided with a protuberant locking bar 36 while the lower edge of the rim 26 is provided with a corresponding locking lip 38. The bar 36 and the lip 38 are adapted to cooperate in snappingly and removingly locking the basket 14 on the main body 12.

A substantially oval prehension aperture 40 extends through the back wall 20 of the main body 12. A corresponding prehension aperture 42 is provided in the back wall 34 of the basket 14. The apertures 40 and 42 are adapted to be in register when the basket is in the locked position illustrated in FIG. 3. The top portion of the aperture 40 has a rounded reinforced edge 44 for smoothing the contact with the user's hand.

Figure 4:
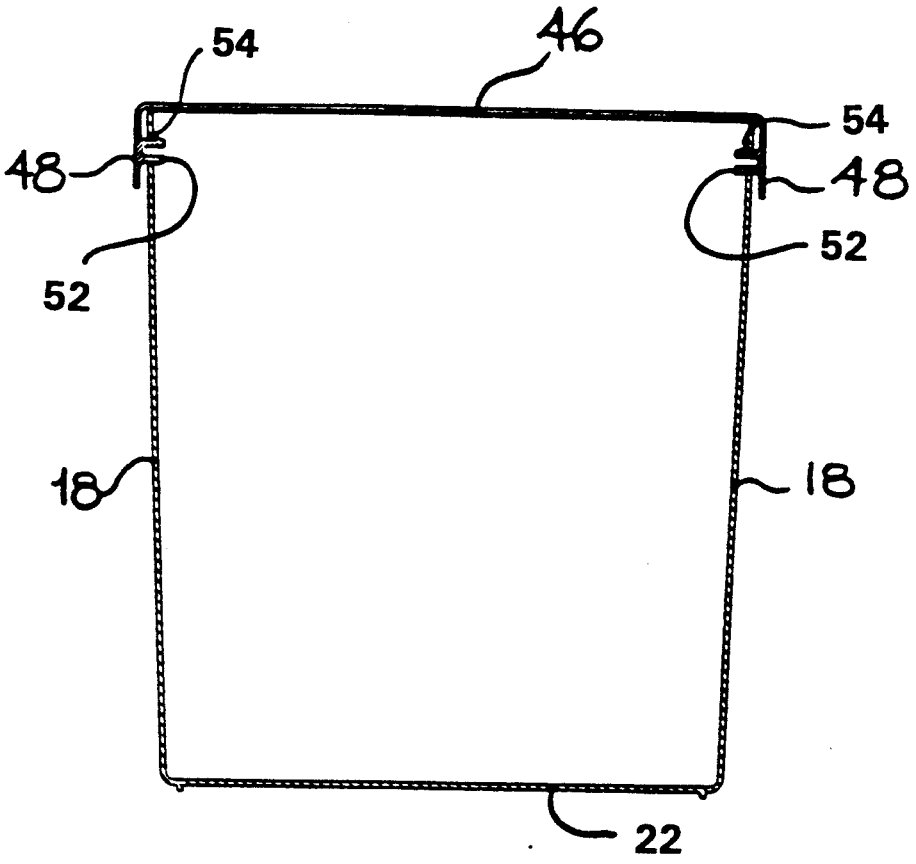
FIG. 4 is a cross-sectional view taken along line 4—4 of FIG. 1.

The main body 12 is also provided with an hinged cover 46. The cover 46 has a pair of integrally and downwardly extending side flanges 48 and an upwardly slanted portion 50. A pair of inwardly projecting pins 52 extend integrally from the side flanges 48. As illustrated in FIG. 4, the pins 52 which act as pivot means are inserted into a pair of corresponding pivot apertures 54 provided in the sidewalls 18.

The cover 46 is adapted to partially cover the open top portion of the main body 12 between the V-shaped notch 24 and the front wall 16.

A spacing between the slanted portion 50 of the cover 46 and the front walls 16 defines an inlet port 55. As illustrated more specifically in FIG. 3, the inlet port 55 is adapted to allow the user to merely drop the recyclable paper 56 into the main container 12 without lifting the cover 46.

The upper end of the front wall 16 extends integrally into an outwardly projecting lip 58. The lip 58 and the slanted portion 50 are adapted to guide the entrance of the paper 56 into the main container 12. The front wall 32 of the basket 14 is spaced from the front wall 16 of the main body 12. The spacing between the walls 32 and 16 define a chute region 33 adapted to guide the paper during its fall into the lower compartment L and to minimize the risk of the paper unwantingly folding during its fall.

Figure 5:
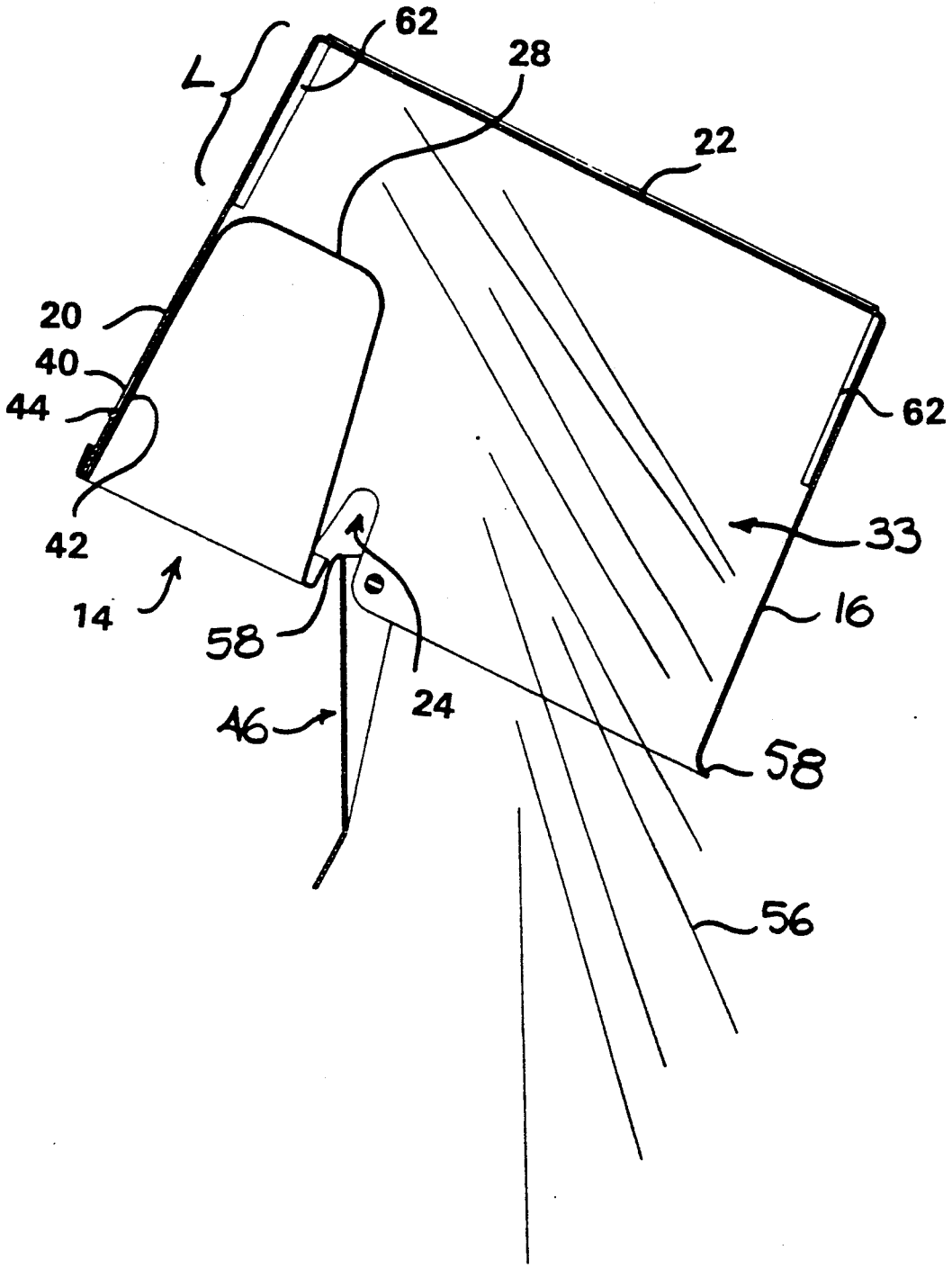
FIG. 5 is a side view of the invention being tilted during an emptying operation of the lower compartment.

As illustrated in FIG. 5, the chute region 33 is also adapted to allow the user to empty the lower compartment L without having to remove the basket 14. This feature is a main advantage over the sighted prior art.

The cover 46 is adapted to pivot between a closed position illustrated in FIGS. 1 and 3 and an opened position illustrated in FIG. 5. When the cover is in the opened position, its rearward edge 58 is adapted to slidingly engage into the V-shaped notch 24. The notch 24 also allows the user to grasp the front part of the rim 26 of the basket 14 thus facilitating the removal by the user for emptying purposes of the basket 14.

During typical use, a conventional plastic bag indicated by the reference numeral 60 is FIG. 3 is positioned inside the basket 14. The notch 24 is again useful in facilitating the wrapping of the edges of the bag 60 around the rim 26.

In use, the basket 14 is typically adapted to receive unrecyclable trash. The basket, indicated by reference letter "T" in FIG. 3, can be readily removed from the main body 12 by a simple upward pulling action. The basket 14 is brought to its releasably locked position illustrated in FIGS. 1 and 3 by a simple downward pressure which snaps the locking lip 38 under the locking bar 36. Since the unrecyclable trash "T" may contain perishable goods, it is conventionally preferable that the unrecyclable trash receiving basket 14 be emptied more often than the recyclable paper compartment. The present invention thus allows the user to independently empty the unrecyclable trash receiving basket 14 while leaving the recyclable paper in stacked relationship in the lower compartment. When the level of recyclable paper in the lower compartment L reaches the base wall 28, the lower compartment L can be emptied as illustrated in FIG. 5 by a simple pivoting action without the need for removing a previously emptied top basket 14. The cover 46 merely pivots around the pins 52 by gravity and the paper 56 falls out through the chute 33.

The present invention thus allows the user to accumulate recyclable paper at his desk and to selectively empty either the top basket 14 or the lower compartment L with simple ergonomical actions.

As illustrated in FIGS. 3 and 5, a set of abutting pins 62 extend upwardly from the base wall 22 of the main body 12. The pins 62 are provided as abutting means when several main bodies 12 are piled one into the other during shipping operations.

The embodiments of the invention in which an exclusive property is claimed are defined as follows:

1. A compartmented waste receptacle for segregating different types of waste comprising:

a main container body with an open top, said main container body having a main body front wall, a main body backwall, a set of main body side walls and a main body bottom wall, a secondary container body positioned inside said main container body and including a secondary body front wall, a secondary body back wall, a set of secondary body side walls and a secondary body bottom wall, said secondary container body having a rim extending integrally from said secondary body front, back and side walls; said main body front, side and back walls having an upper edge, said rim of said secondary body back and side walls correspondingly resting on said upper edge of said main body back and side walls, said secondary container body covering only one portion of the main container body open top, said secondary container body being fixed to said main container body with said secondary body bottom wall positioned above said main body bottom wall such that said secondary body and main body bottom walls, a portion of said main body side walls, a portion of said main body front wall and a portion of said main body back wall define a lower compartment, said secondary body front wall being spaced from said main body front wall such that said secondary and main body front wall define a chute, with an open top portion extending over the remaining portion of the main container body open top, and said chute leads to said lower compartment, said waste receptacle further comprising a hinged cover pivoting between a generally vertical opened and a horizontal closed position, said cover partially covering said opened top portion of said chute when positioned in said horizontal closed position.

2. A compartmented waste receptacle as recited in claim 1, wherein said secondary container body is removably fixed to said main container body by a releasable fastening means, said secondary container body emptying independently from said main container body.

3. A compartmented waste receptacle as recited in claim 2, wherein said releasable fastening means comprises a protuberant locking bar extending from said main body back wall and a corresponding locking lip extending integrally from said rim of said secondary body back wall, said bar snappingly engaging below said lip for releasably locking said secondary container body to said main container body.

4. A compartmented waste receptacle as recited in claim 1, wherein said cover comprises a pair of integrally and downwardly extending side flanges and a pair of inwardly projecting pins extending integrally from said side flanges, said pins being inserted into a corresponding pivot aperture provided in said main container body side walls.

5. A compartmented waste receptacle as recited in claim 1, wherein said hinged cover comprises an upwardly slanted front portion and a spacing between said main body front wall, said spacing defines an inlet port allowing a user to insert a piece of paper in said chute when said cover is in said closed position.

6. A compartmented waste receptacle as recited in claim 5, wherein said main container body side walls are provided with a substantially V-shaped notch, a rearward edge of said cover engaging said V-shaped notch when said cover is in said opened position.

7. A compartmented waste receptacle as recited in claim 1, wherein said waste receptacle is provided with a prehension aperture extending through said main container body back wall and said secondary container body back wall.

* * * * *